US011664606B2

(12) United States Patent
Chen et al.

(10) Patent No.: US 11,664,606 B2
(45) Date of Patent: May 30, 2023

(54) ANTENNA STRUCTURE AND ARRAY ANTENNA MODULE

(71) Applicant: Au Optronics Corporation, Hsinchu (TW)

(72) Inventors: Shih-Yuan Chen, Hsinchu (TW); Hsiu-Ping Liao, Hsinchu (TW); Chun-I Wu, Hsinchu (TW); Yi-Chen Hsieh, Hsinchu (TW); Yi-Hsiang Lai, Hsinchu (TW); Ching-Huan Lin, Hsinchu (TW); Chuang Yueh Lin, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 55 days.

(21) Appl. No.: 17/395,486

(22) Filed: Aug. 6, 2021

(65) Prior Publication Data

US 2022/0216621 A1 Jul. 7, 2022
US 2022/0216621 A1 Jul. 7, 2022

(30) Foreign Application Priority Data

Jan. 5, 2021 (TW) ..... 110100210

(51) Int. Cl.
*H01Q 21/06* (2006.01)
*H01Q 1/48* (2006.01)
(Continued)

(52) U.S. Cl.
CPC ..... *H01Q 21/065* (2013.01); *H01Q 7/005* (2013.01); *H01Q 9/0442* (2013.01); *H01Q 1/48* (2013.01)

(58) Field of Classification Search
CPC ..... H01Q 21/065; H01Q 1/38; H01Q 21/08; H01Q 3/34; H01Q 7/005; H01Q 9/0442; H01Q 1/48; H01Q 7/00
See application file for complete search history.

(56) References Cited

U.S. PATENT DOCUMENTS 3,434,145 A * 3/1969 Wells ..... H01Q 9/265 343/726
3,751,137 A * 8/1973 Fitzgibbons ..... G02F 1/1341 345/87
(Continued)

FOREIGN PATENT DOCUMENTS

CN 104409860 3/2015
CN 105914470 A * 8/2016 ..... H01Q 9/0442
(Continued)

OTHER PUBLICATIONS

N. Kumar & N. Sharma, The Various Feeding Techniques of microstrip Patch Antenna Using HFSS, Jun. 2019, SSRG International Journal of Electronics and Communication Engineering, vol. 6 Issue 6, pp. 23-29 (Year: 2019).*
(Continued)

*Primary Examiner* — Dimary S Lopez Cruz
*Assistant Examiner* — Jordan E. DeWitt
(74) *Attorney, Agent, or Firm* — JCIPRNET

(57) ABSTRACT

An antenna structure includes a patch antenna including two opposite edges, a microstrip line connected to the patch antenna, two first radiation assemblies respectively disposed on two sides of the patch antenna, two second radiation assemblies disposed under the two first radiation assemblies, a liquid crystal layer disposed between a first plane and a second plane, and a ground plane disposed under the two second radiation assemblies. The patch antenna, the microstrip line, and the two first radiation assemblies are located on the first plane, and each of the first radiation assemblies includes multiple separated first conductors. The two second radiation assemblies are located on the second plane, and each of the second radiation assemblies includes multiple separated second conductors. A projection of the two second radiation assemblies on the first plane, the two
(Continued)

first radiation assemblies, and the two edges of the patch antenna collectively form two loops.

20 Claims, 14 Drawing Sheets

(51) Int. Cl.
*H01Q 9/04* (2006.01)
*H01Q 7/00* (2006.01)

(56) References Cited

U.S. PATENT DOCUMENTS 5,325,094 A * 6/1994 Broderick ..... H01Q 15/0026 342/1
5,374,935 A * 12/1994 Forrest ..... H01Q 3/2676 342/368
5,623,280 A * 4/1997 Akins ..... G02F 1/13338 349/158
5,905,462 A * 5/1999 Hampel ..... H01Q 3/26 342/368
5,978,125 A * 11/1999 Yao ..... H01Q 3/2682 359/259
6,034,647 A * 3/2000 Paul ..... H01Q 21/0087 343/778
6,091,367 A * 7/2000 Kabashima ..... H01Q 21/065 343/846
6,239,762 B1 * 5/2001 Lier ..... H01Q 21/24 343/846
6,297,777 B1 * 10/2001 Tsubaki ..... H01Q 9/0414 343/702
6,552,696 B1 * 4/2003 Sievenpiper ..... H01Q 3/44 343/754
7,046,198 B2 * 5/2006 Sakiyama ..... H01Q 15/002 343/824
7,209,083 B2 * 4/2007 Fujishima ..... H01Q 1/38 343/847
7,466,269 B2 * 12/2008 Haziza ..... H01Q 9/0442 343/702
7,609,971 B1 * 10/2009 Zhou ..... H01Q 25/00 398/115
7,632,740 B2 * 12/2009 Aoki ..... H01L 24/97 438/149
7,715,089 B2 * 5/2010 Song ..... G02F 1/1679 349/33
7,830,301 B2 * 11/2010 Margomenos ..... H01Q 21/065 343/700 R
8,013,784 B2 * 9/2011 Margomenos ..... G01S 7/032 342/368
8,319,689 B2 * 11/2012 Kim ..... H01Q 9/0442 343/843
8,786,507 B2 * 7/2014 Ayatollahi ..... H01Q 1/38 455/575.1
8,830,133 B2 * 9/2014 Weily ..... H01Q 13/106 343/770
8,872,725 B1 * 10/2014 Weller ..... H01Q 9/285 343/756
9,322,977 B2 * 4/2016 Kuo ..... G02B 6/0061
9,391,375 B1 * 7/2016 Bales ..... H01Q 21/064
9,531,077 B1 * 12/2016 Weller ..... H01Q 1/38
9,780,434 B1 * 10/2017 Weller ..... H01Q 9/065
10,141,620 B2 * 11/2018 Jakoby ..... H01Q 9/0457
10,177,444 B2 * 1/2019 Nakazawa ..... H01Q 1/125
10,564,487 B2 * 2/2020 Suzuki ..... H01L 27/1255
10,629,973 B2 * 4/2020 Jakoby ..... H01P 1/181
10,637,133 B2 * 4/2020 Lu ..... H01Q 1/405
10,637,156 B2 * 4/2020 Ohtake ..... H01Q 3/44
10,680,332 B1 * 6/2020 Li ..... H01Q 13/106
10,756,430 B2 * 8/2020 Asagi ..... H01Q 3/44
10,795,209 B2 * 10/2020 Wang ..... G02F 1/1343
11,005,148 B2 * 5/2021 Zhang ..... H01Q 3/36
11,069,976 B1 * 7/2021 Xi ..... H01Q 21/065
11,075,455 B2 * 7/2021 Lu ..... H01Q 9/0407
11,095,028 B2 * 8/2021 Ting ..... H01Q 9/16
11,165,139 B1 * 11/2021 Paulotto ..... H01Q 15/0026
11,233,320 B2 * 1/2022 Lu ..... H01Q 3/44
11,374,317 B2 * 6/2022 Kao ..... H01Q 3/44
11,462,826 B2 * 10/2022 Wu ..... H01Q 21/0075
11,469,500 B2 * 10/2022 Yang ..... H01Q 3/36
11,476,589 B2 * 10/2022 Pourmousavi ..... H01Q 9/16
2003/0080899 A1 * 5/2003 Lee ..... H01Q 3/2676 342/368
2004/0067013 A1 * 4/2004 Gu ..... G02F 1/292 349/193
2005/0122266 A1 * 6/2005 Chang ..... H01Q 21/065 343/700 MS
2005/0174290 A1 * 8/2005 Huang ..... H01Q 1/38 29/601
2007/0139285 A1 * 6/2007 Maruyama ..... G06K 19/07749 343/866
2008/0074168 A1 * 3/2008 Meng ..... H03K 17/6871 327/434
2009/0167699 A1 * 7/2009 Rosenblatt ..... H01Q 7/00 345/173
2009/0278744 A1 * 11/2009 Kirino ..... H01P 1/184 343/700 MS
2010/0134376 A1 * 6/2010 Margomenos ..... H01Q 21/065 343/860
2012/0274523 A1 * 11/2012 Ayatollahi ..... H01Q 1/243 343/834
2013/0176177 A1 * 7/2013 Cetiner ..... H01Q 9/0442 343/700 MS
2014/0043189 A1 * 2/2014 Lee ..... H01Q 9/0485 342/368
2014/0098316 A1 * 4/2014 You ..... G02F 1/1334 438/30
2014/0266946 A1 * 9/2014 Bily ..... H01Q 3/22 343/771
2014/0292590 A1 * 10/2014 Yoo ..... H01Q 5/371 343/702
2015/0015455 A1 * 1/2015 Maruyama ..... H01Q 21/0018 343/912
2015/0022414 A1 * 1/2015 Maruyama ..... H01Q 15/0086 343/912
2015/0123748 A1 * 5/2015 Stevenson ..... H01P 7/088 156/289
2015/0155636 A1 * 6/2015 Maruyama ..... H01Q 21/29 343/729
2015/0253419 A1 * 9/2015 Alland ..... G01S 13/42 342/385
2016/0241217 A1 * 8/2016 Sazegar ..... G02F 1/13306
2017/0062953 A1 * 3/2017 Teshima ..... H01Q 9/42
2017/0229784 A1 * 8/2017 Kitamura ..... H01Q 9/0414
2017/0365933 A1 * 12/2017 Topak ..... H01Q 21/005
2018/0061869 A1 * 3/2018 Suzuki ..... G02F 1/134309
2018/0062238 A1 * 3/2018 Haziza ..... H01P 1/2002
2018/0062266 A1 * 3/2018 Haziza ..... H01L 23/66
2018/0205148 A1 * 7/2018 Li ..... H01Q 9/16
2018/0205156 A1 * 7/2018 Li ..... H01Q 21/0075
2018/0287257 A1 * 10/2018 Sasaki ..... H01Q 3/26
2018/0294556 A1 * 10/2018 Lu ..... H01Q 3/26
2018/0294557 A1 * 10/2018 Lu ..... H01Q 19/067
2018/0294562 A1 * 10/2018 Lu ..... H01Q 1/52
2018/0316090 A1 * 11/2018 Foo ..... H01Q 15/002
2019/0089069 A1 * 3/2019 Niroo ..... H01Q 13/10
2019/0140363 A1 * 5/2019 Otsubo ..... H01Q 21/00
2019/0148824 A1 * 5/2019 Kitoh ..... H01L 27/1225 343/789
2019/0157730 A1 * 5/2019 Oppenlaender ..... H01Q 3/34
2019/0237870 A1 * 8/2019 Asagi ..... H01L 27/124
2019/0237879 A1 * 8/2019 Park ..... H01Q 1/243
2019/0356057 A1 * 11/2019 Carey ..... H01Q 21/065
2019/0363434 A1 * 11/2019 Ting ..... H01Q 1/50
2019/0363452 A1 * 11/2019 Ting ..... G02F 1/1313
2019/0372226 A1 * 12/2019 Sharawi ..... H01Q 1/38
2019/0385960 A1 * 12/2019 Misaki ..... H01L 27/1255
2020/0243969 A1 * 7/2020 Fang ..... H01Q 3/36
2020/0243973 A1 * 7/2020 Hsieh ..... H01Q 9/285
2020/0243974 A1 * 7/2020 Hsieh ..... H01Q 1/38
2020/0251812 A1 * 8/2020 Tseng ..... H01L 21/045

(56) References Cited

U.S. PATENT DOCUMENTS

| | | | | |
|---|---|---|---|---|
| 2020/0259271 | A1* | 8/2020 | Lin | H01Q 3/34 |
| 2020/0266511 | A1* | 8/2020 | Kong | H01P 1/18 |
| 2020/0343633 | A1* | 10/2020 | Yasuo | H01Q 21/064 |
| 2020/0358193 | A1* | 11/2020 | Sasaki | H04B 5/0081 |
| 2020/0381824 | A1* | 12/2020 | Kao | H01Q 3/247 |
| 2021/0005978 | A1* | 1/2021 | Pourmousavi | H01Q 21/065 |
| 2021/0050656 | A1* | 2/2021 | Kang | H01Q 1/243 |
| 2021/0167497 | A1* | 6/2021 | Wu | H01Q 23/00 |
| 2021/0367336 | A1* | 11/2021 | Jia | H01P 1/20 |
| 2021/0384613 | A1* | 12/2021 | Koul | H01Q 9/045 |
| 2022/0006188 | A1* | 1/2022 | Tang | G02F 1/1313 |
| 2022/0123470 | A1* | 4/2022 | Kim | H01Q 15/006 |
| 2022/0344832 | A1* | 10/2022 | Sayama | H01Q 13/10 |

FOREIGN PATENT DOCUMENTS

| | | | | | |
|---|---|---|---|---|---|
| CN | 106252886 | A | * | 12/2016 | H01Q 3/24 |
| CN | 106684551 | A | * | 5/2017 | G02F 1/133308 |
| CN | 106961008 | | | 7/2017 | |
| CN | 106961008 | A | * | 7/2017 | H01Q 1/36 |
| CN | 107528121 | A | * | 12/2017 | G02F 1/137 |
| CN | 108321541 | | | 7/2018 | |
| CN | 108321541 | A | * | 7/2018 | H01Q 1/38 |
| CN | 108615966 | A | * | 10/2018 | G02F 1/1313 |
| CN | 112018518 | A | * | 12/2020 | G02F 1/1333 |
| CN | 113871860 | A | * | 12/2021 | H01Q 21/065 |
| EP | 3835852 | A1 | * | 6/2021 | G02F 1/1313 |
| JP | 2012085145 | A | * | 4/2012 | |
| WO | WO-2014125095 | A1 | * | 8/2014 | H01G 7/06 |

OTHER PUBLICATIONS

Christian Wolff, Phased Array Antenna—Calculation of the phase shift, ca. 2008, radartutorial.eu https://www.radartutorial.eu/06.antennas/Phased%20Array%20Antenna.en.html (Year: 2008).*

* cited by examiner

ANTENNA STRUCTURE AND ARRAY ANTENNA MODULE

CROSS-REFERENCE TO RELATED APPLICATION

This application claims the priority benefit of Taiwan application serial no. 110100210, filed on Jan. 5, 2021. The entirety of the above-mentioned patent application is hereby incorporated by reference herein and made a part of this specification.

BACKGROUND

Technical Field

The disclosure relates to an antenna structure and an array antenna module, and more particularly, to a liquid crystal antenna structure and an array antenna module.

Description of Related Art

With the ever-increasing demand for the functions and performance of wireless devices, coupled with the lack of electromagnetic spectrum, the demand for adjustable operating frequencies of antennas is gradually increasing. At present, frequency modulated antennas generally use microelectromechanical systems, diodes, field-effect transistor switches, etc. to achieve adjustable functions. However, the above adjustable methods are all discrete adjustments, which means that they may only hop between specific frequency points. In order for the frequency change of the modulation process to be continuous, a feasible method is to use the anisotropy of the liquid crystal material to realize electrical adjustment and achieve continuous modulation capability.

However, in the current antenna combination using a patch antenna and a liquid crystal layer, the liquid crystal layer is required to have a certain thickness, which will increase the manufacturing cost, while the response speed of the liquid crystal is also relatively slow, and the liquid crystal has more power consumption.

SUMMARY

The disclosure provides an antenna structure, which may have a relatively thin liquid crystal layer.

The disclosure provides an array antenna module, which has the antenna structure.

The antenna structure of the disclosure includes a patch antenna, a microstrip line, two first radiation assemblies, two second radiation assemblies, a liquid crystal layer, and a ground plane. The patch antenna includes two opposite edges. The microstrip line is connected to the patch antenna. The two first radiation assemblies are respectively disposed on two sides of the patch antenna. The patch antenna, the microstrip line, and the two first radiation assemblies are located on a first plane, and each of the first radiation assemblies includes multiple separated first conductors. The two second radiation assemblies are disposed under the two first radiation assemblies and located on a second plane, and each of the second radiation assemblies includes multiple separated second conductors. A projection of the two second radiation assemblies on the first plane, the two first radiation assemblies, and the two edges of the patch antenna collectively form two loops. The liquid crystal layer is disposed between the first plane and the second plane. The ground plane is disposed under the two second radiation assemblies.

In an embodiment of the disclosure, an extending direction of the two edges of the patch antenna extends toward a first extending direction of the microstrip line, and the loop has a long side extending toward the first extending direction of the microstrip line.

In an embodiment of the disclosure, a width of the first conductor in an extending direction of a short side is less than a width of the second conductor in the extending direction.

In an embodiment of the disclosure, the two second radiation assemblies are connected to each other through two conducting wires. The two second radiation assemblies are divided into an inner zone and two outer zones located at two sides of the inner zone by a second extending direction of the two conducting wires, and the second conductors of the second radiation assemblies are only located in the two outer zones.

In an embodiment of the disclosure, the first conductors are staggered from the second conductors.

In an embodiment of the disclosure, the antenna structure further includes a thin film transistor and multiple first circuits connected to the thin film transistor and the first conductors. The first conductors are electrically connected to the thin film transistor through the first circuits. The thin film transistor supplies a voltage to the first conductors to adjust a dielectric constant of the liquid crystal layer.

In an embodiment of the disclosure, the first circuits are respectively perpendicular to the connected first conductors.

In an embodiment of the disclosure, the antenna structure further includes multiple second circuits connected to the ground plane and the second conductors, and the second conductors are electrically connected to the ground plane through the second circuits.

In an embodiment of the disclosure, the second circuits are respectively perpendicular to the connected second conductors.

In an embodiment of the disclosure, the antenna structure further includes a first substrate and a second substrate which are disposed up and down, and separated from each other. The patch antenna, the microstrip line, and the two first radiation assemblies are disposed on the first substrate, and the two second radiation assemblies are disposed on the second substrate. The first plane is a surface of the first substrate facing the second substrate, and the second plane is a surface of the second substrate facing the first substrate. The liquid crystal layer is located between the first substrate and the second substrate.

In an embodiment of the disclosure, the ground plane is disposed on a surface of the second substrate away from the first substrate.

In an embodiment of the disclosure, the ground plane is disposed on a third substrate, and the ground plane is attached to the surface of the second substrate away from the first substrate.

In an embodiment of the disclosure, the antenna structure resonates in a frequency band, and a thickness of the liquid crystal layer is less than 0.005 times a wavelength of the frequency band.

The array antenna module of the disclosure includes multiple antenna structures, which are arranged in an array.

In an embodiment of the disclosure, the antenna structures include multiple first antenna structures. The microstrip lines of the first antenna structures have a variety of lengths. A phase difference of the first antenna structures is non-zero. Phases of the first antenna structures along the second extending direction are an arithmetic series.

In an embodiment of the disclosure, a difference between the lengths of any two adjacent ones of the microstrip lines of the first antenna structures is $\lambda g*(P/360)$, where $\lambda g$ is an effective wavelength of a feeding signal in the antenna structure, and P is a phase difference (°) between the two adjacent microstrip lines.

In an embodiment of the disclosure, the phase difference of the first antenna structures is $P=(360*d*\sin\theta)/\lambda$, where $\theta$ is a radiation angle, while $\lambda$ is a radiation wavelength, and d is a distance between any two adjacent ones of the first antenna structures.

In an embodiment of the disclosure, the antenna structures further include multiple second antenna structures. A phase difference of the second antenna structures is 0. The first antenna structures and the second antenna structures are successively arranged along the second extending direction or the first extending direction, and an antenna radiation direction is adjusted by operating at different timings.

In an embodiment of the disclosure, a third extending direction is perpendicular to the first extending direction and the second extending direction. When the first antenna structures have radiation signals (ON), and the second antenna structures do not have the radiation signals (OFF), an angle is included between the antenna radiation direction and the third extending direction, and the angle is greater than 0 and less than 90 degrees. When the first antenna structures do not have the radiation signals (OFF), and the second antenna structures have the radiation signals (ON), the antenna radiation direction is parallel to the third extending direction.

In an embodiment of the disclosure, lengths of the microstrip lines of the first antenna structures are greater than lengths of the microstrip lines of the second antenna structures.

Based on the above, in the antenna structure of the disclosure, the two first radiation assemblies are respectively disposed on the two sides of the patch antenna, and the two second radiation assemblies are disposed under the two first radiation assemblies. The projection of the two second radiation assemblies on the first plane, the two first radiation assemblies, and the two edges of the patch antenna collectively form the two loops. The liquid crystal layer is disposed between the first plane and the second plane. The ground plane is disposed under the two second radiation assemblies. In the disclosure, the first conductors and the second conductors are disposed above and below the liquid crystal layer to generate a multi-capacitance path of a signal. In the conventional technology, the antenna structure using the liquid crystal layer determines a radiation frequency offset by the thickness of the liquid crystal layer, and thus the thick liquid crystal layer is required. In the antenna structure of the disclosure, through the above multi-capacitance path, a fringe radiation field of the patch antenna may change the radiation frequency according to the capacitance change generated by the multi-capacitance path. Therefore, the thickness of the liquid crystal layer of the antenna structure in the disclosure may be greatly reduced, thereby reducing the cost and power consumption.

DETAILED DESCRIPTION OF DISCLOSED EMBODIMENTS

Figure 1:
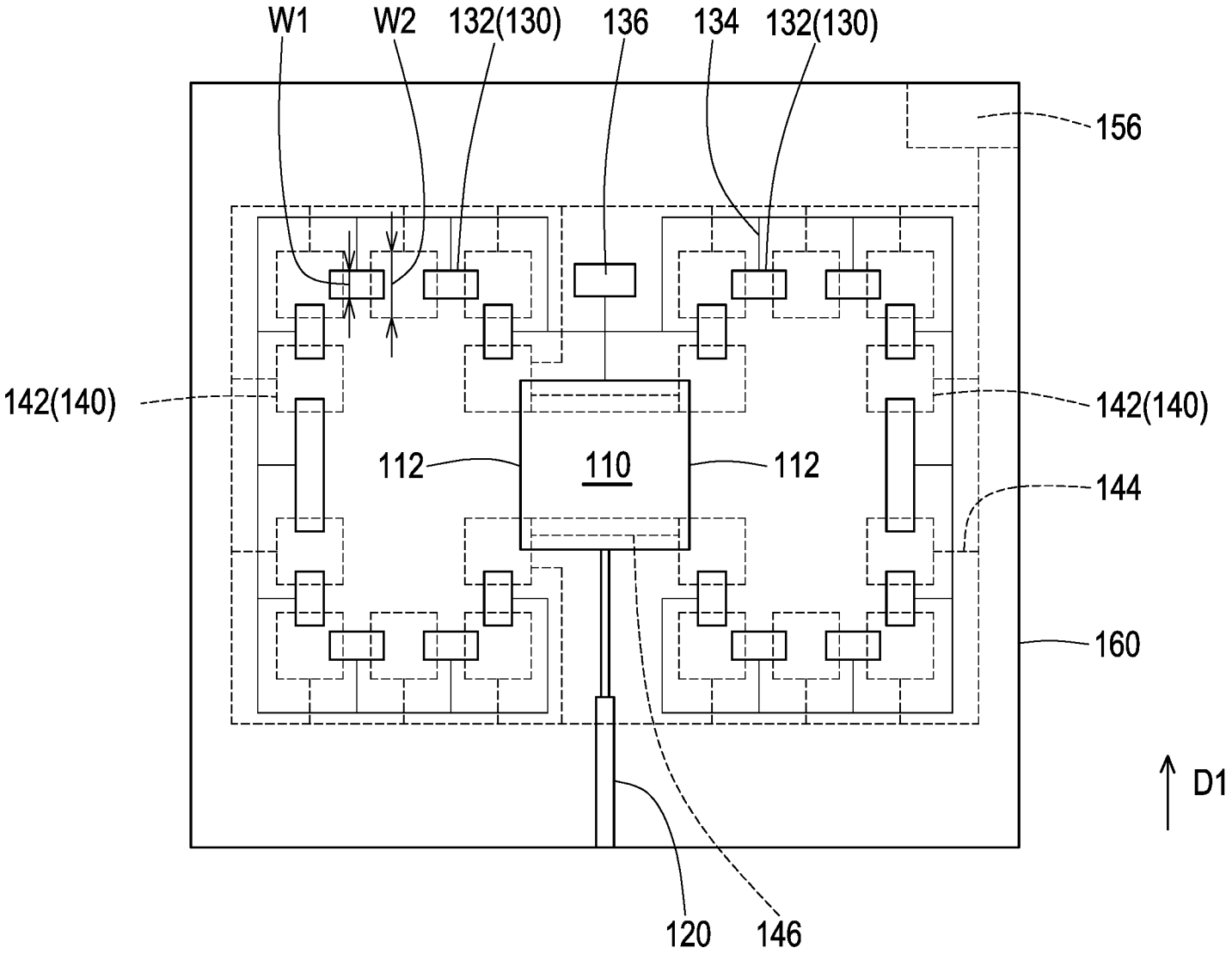
FIG. 1 is a schematic top view of an antenna structure according to an embodiment of the disclosure.
Figure 2:
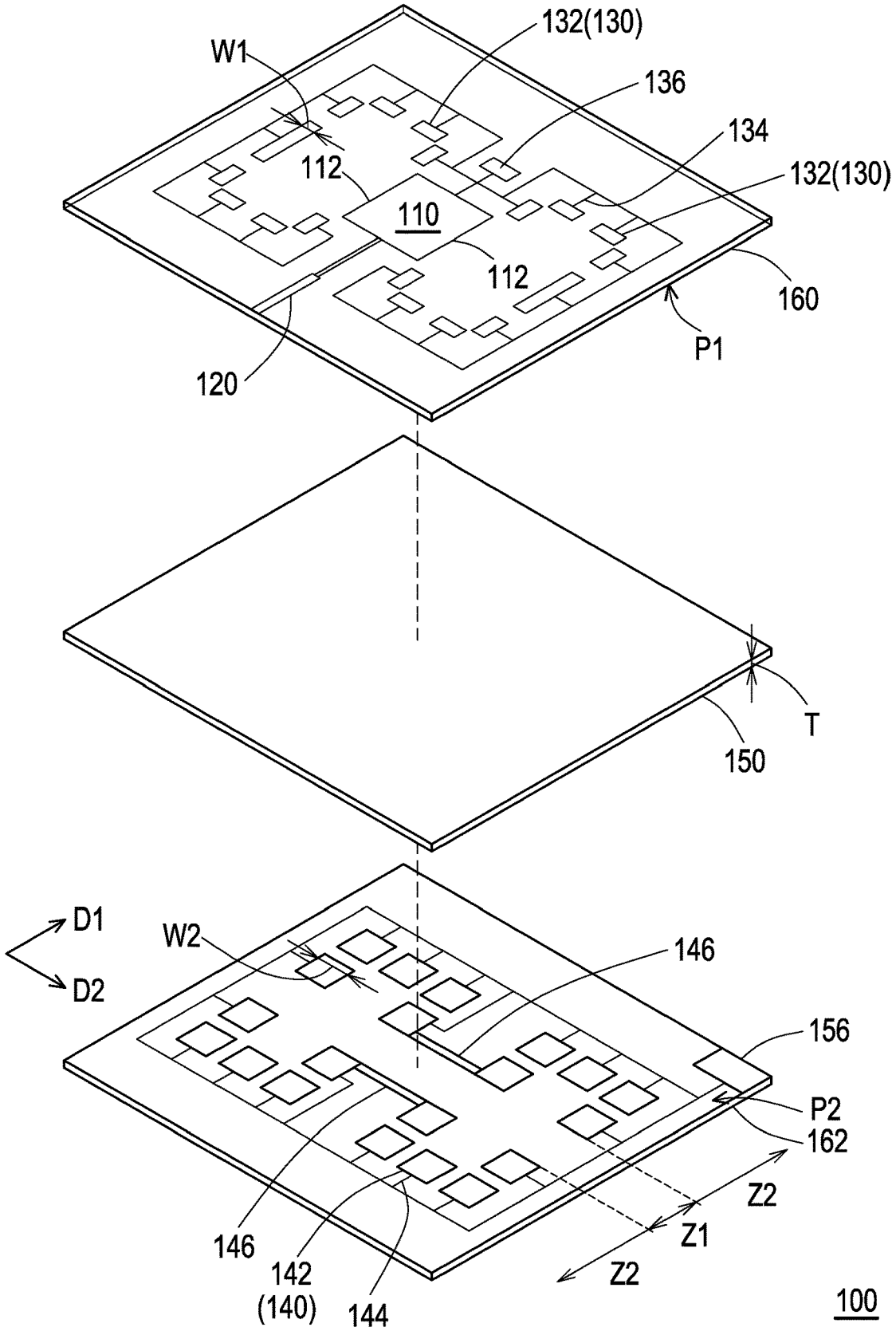
FIG. 2 is a schematic exploded view of the antenna structure of FIG. 1.

FIG. 1 is a schematic top view of an antenna structure according to an embodiment of the disclosure. FIG. 2 is a schematic exploded view of the antenna structure of FIG. 1. It should be noted that a size ratio of components in the figures is only for schematic illustration.

Figure 3:
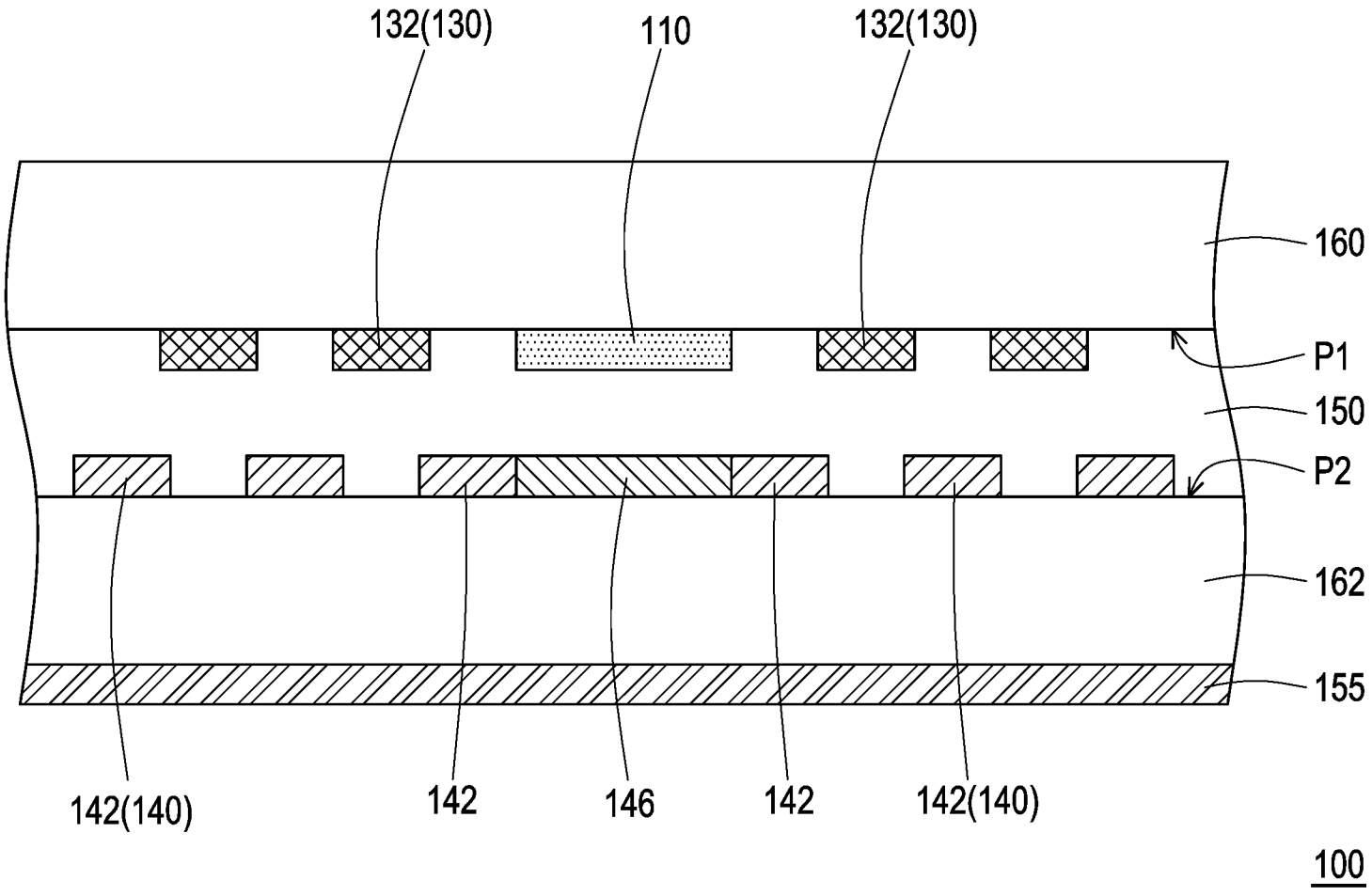
FIG. 3 is a schematic partial cross-sectional view of the antenna structure of FIG. 1.

Referring to FIGS. 1 to 3, an antenna structure 100 of this embodiment includes a patch antenna 110, a microstrip line 120, two first radiation assemblies 130, two second radiation assemblies 140, a liquid crystal layer 150 (FIG. 2), and a ground plane 155 (FIG. 3).

As shown in FIG. 2, the patch antenna 110 includes two opposite edges 112. The microstrip line 120 is connected to the patch antenna 110. An extending direction of the two edges 112 of the patch antenna 110 extends toward a first extending direction D1 of the microstrip line 120. In this embodiment, the patch antenna 110 is rectangular. The antenna structure 100 radiates a frequency band, and a length of the edge 112 of the patch antenna 110 is close to ½ wavelength of the frequency band.

The two first radiation assemblies 130 are symmetrically disposed on two sides of the patch antenna 110, respectively. Each of the first radiation assemblies 130 includes multiple separated first conductors 132. The two second radiation assemblies 140 are disposed under the two first radiation assemblies 130, and are symmetrical to the two sides of the patch antenna 110. Each of the second radiation assemblies 140 includes multiple separated second conductors 142. The first conductors 132 are at least partially staggered from the second conductors 142.

In this embodiment, a shape and size of the first conductor 132 and the second conductor 142 are different, and a width W1 of the first conductor 132 in an extending direction of a short side is less than a width W2 of the second conductor 142 in the extending direction. The two second radiation assemblies 140 are connected to each other through two conducting wires 146. As shown in FIG. 2, the two second radiation assemblies 140 are divided into an inner zone Z1 and two outer zones Z2 located at two sides of the inner zone Z1 by a second extending direction D2 of the two conducting wires 146. In this embodiment, the second conductors 142 of the two second radiation assemblies 140 are only located in the two outer zones Z2.

The patch antenna 110, the microstrip line 120, and the two first radiation assemblies 130 are located on a first plane P1. The two second radiation assemblies 140 are disposed under the two first radiation assemblies 130 and located on a second plane P2. Specifically, the antenna structure 100 further includes a first substrate 160 and a second substrate 162 disposed up and down and separated from each other. The first substrate 160 and the second substrate 162 may be glass plates or plastic plates. Materials of the first substrate 160 and the second substrate 162 are not limited, as long as a tangent loss in an operating frequency band of an antenna is less than 0.05.

The patch antenna 110, the microstrip line 120, and the two first radiation assemblies 130 are disposed on the first substrate 160, and the two second radiation assemblies 140 are disposed on the second substrate 162. The first plane P1 is a surface of the first substrate 160 facing the second substrate 162, and the second plane P2 is a surface of the second substrate 162 facing the first substrate 160. The liquid crystal layer 150 is located between the first substrate 160 and the second substrate 162, and located between the first plane P1 and the second plane P2. The liquid crystal layer 150 is used as a modulation layer of a radiation frequency.

As shown in FIG. 3, the ground plane 155 is disposed under the two second radiation assemblies 140. Specifically, in this embodiment, the ground plane 155 is disposed on a surface of the second substrate 162 away from the first substrate 160. During manufacturing, the ground plane 155 may be directly plated on a bottom surface of the second substrate 162, but a manufacturing method of the ground plane 155 is not limited thereto.

Figure 4:
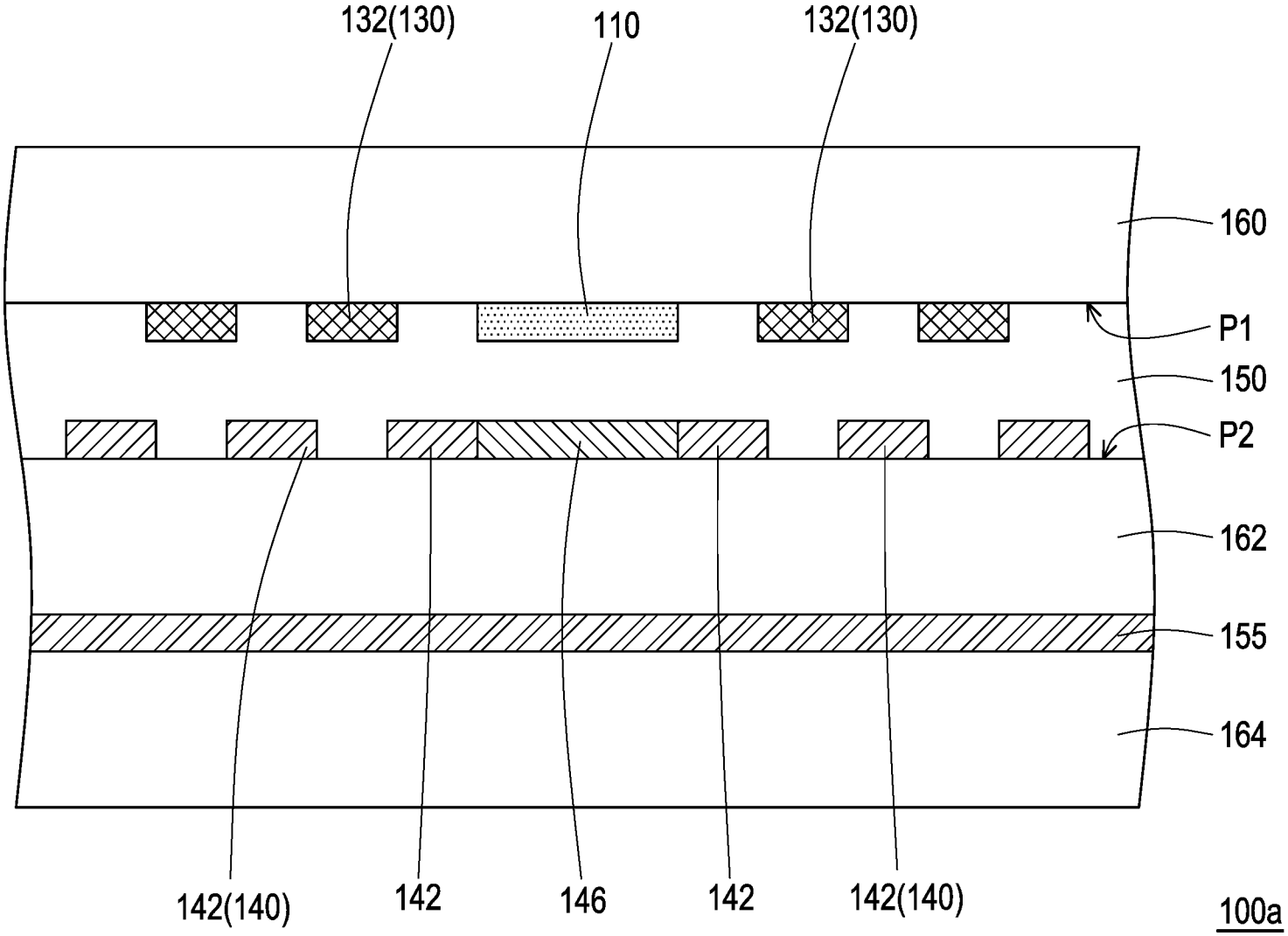
FIG. 4 is a schematic partial cross-sectional view of an antenna structure according to an embodiment of the disclosure.

FIG. 4 is a schematic partial cross-sectional view of an antenna structure according to an embodiment of the disclosure. Referring to FIG. 4, a main difference between an antenna structure 100*a* of FIG. 4 and FIG. 3 is that in this embodiment, the ground plane 155 is disposed on a third substrate 164, and the ground plane 155 and the third substrate 164 are attached to the surface (the bottom surface) of the second substrate 162 away from the first substrate 160. In other words, the ground plane 155 may be formed on a top surface of the third substrate 164 and then attached to the bottom surface of the second substrate 162.

Returning to FIG. 2, in this embodiment, the antenna structure 100 further includes a thin film transistor 136 and multiple first circuits 134 connected to the thin film transistor 136 and the first conductors 132. The first circuits 134 are connected to each other, and the first conductors 132 are electrically connected to at least one thin film transistor 136 through the first circuits 134.

In addition, the antenna structure 100 further includes multiple second circuits 144 connected to the ground plane 155 (FIG. 3) and the second conductors 142. The second circuits 144 are connected to each other, and the second conductors 142 are electrically connected to the ground plane 155 through the second circuits 144. Specifically, a ground pad 156 which is electrically connected to the ground plane 155 below is disposed on the second plane P2. The ground pad 156 and the ground plane 155 are, for example, conducted through a structure such as a conductive via (not shown), and may also be directly connected to the external ground plane 155 by using a conductive material (such as a conductive tape). The second circuits 144 are connected to the ground pad 156 to be electrically connected to the ground plane 155 on the other surface.

The thin film transistor 136 supplies a voltage to the first conductors 132, so that there is a voltage difference between the first conductors 132 and the second conductors 142 (equipotential to the ground plane 155). As a result, an electric field is formed to control an aligning direction of liquid crystal molecules in the liquid crystal layer 150, so as to adjust a dielectric constant of the liquid crystal layer 150.

It should be noted that the position, number, and size of the thin film transistor 136 are not limited by the drawing. In addition, the first conductor 132 and the second conductor 142 may be metal or non-metal conductors, and may also be transparent electrodes. The types of the first conductor 132 and the second conductor 142 are not limited thereto.

It should be noted that in this embodiment, the first circuits 134 are respectively perpendicular to the connected first conductors 132, and the second circuits 144 are respectively perpendicular to the connected second conductors 142. Such a design may enable a current direction (along an edge of the first conductor 132) on a surface of the first conductor 132 to be perpendicular to an extending direction of the connected first circuit 134, and a current direction (along an edge of the second conductor 142) on a surface of the second conductor 142 to be perpendicular to an extending direction of the connected second circuit 144, which may reduce an interference of a bias signal (a low frequency to 60 Hz) and a high frequency signal of an antenna (>1 GHz).

Referring to FIG. 1, in this embodiment, a projection of the two second radiation assemblies 140 on the first plane P1, the two first radiation assemblies 130, and the two edges 112 of the patch antenna 110 collectively form two loops. In this embodiment, a shape of the loop is a rectangle, and a long side of the loop extends toward the first extending direction D1 of the microstrip line 120. In an embodiment, the loop may also be a non-closed loop, and the shape of the loop is not limited by the drawing.

In the antenna structure 100 of this embodiment, the two first radiation assemblies 130 and the two second radiation assemblies 140 are disposed above and below the liquid crystal layer 150. A projection of the second conductors 142 of the two second radiation assemblies 140 on the first plane P1, the first conductors 132 of the two first radiation assemblies 130, and the two edges 112 of the patch antenna 110 collectively form two loops. Such a design may enable the first conductors 132 and the second conductors 142 to be alternately arranged up and down to generate a multi-capacitance path of a radiation signal, so that the signal resonates between the first conductors 132 and the second conductors 142 alternately arranged up and down.

Therefore, a fringe radiation field of the patch antenna 110 located in the center may change the radiation frequency due to a capacitance change generated by alternately stacking the first conductors 132 and the second conductors 142. In other words, the antenna structure 100 of this embodiment is an antenna structure that generates radiation by using a resonance of high-frequency LC.

In the conventional technology, an antenna structure using a liquid crystal layer determines a radiation frequency offset by a thickness of the liquid crystal layer, and thus the thick liquid crystal layer is required. In this embodiment, the antenna structure 100 enhances an influence of the modulation of liquid crystal on a resonance of a radiator by using the multi-capacitance path, and achieves an adjustable capacitance by using an external voltage to change the dielectric constant of the liquid crystal layer 150. Therefore, the antenna structure 100 of this embodiment does not need to change the radiation frequency by applying a high voltage to the thick liquid crystal layer, so that a thickness of the liquid crystal layer 150 may be greatly reduced, thereby reducing the cost and power consumption.

For example, the antenna structure 100 resonates in the frequency band, and a thickness T (FIG. 2) of the liquid crystal layer 150 is less than 0.005 times the wavelength of the frequency band. Specifically, the thickness T (FIG. 2) of the liquid crystal layer 150 required in this embodiment at 34

GHz is about 5 μm ($0.0006\lambda_0$). The thickness T of the liquid crystal layer 150 in this embodiment may be reduced by 14 times compared with the conventional technology. A driving voltage may be reduced from 90V to 9V, and the radiation frequency may be modulated by 8%. The antenna structure 100 may be made by general display manufacturing process.

Figure 5B:
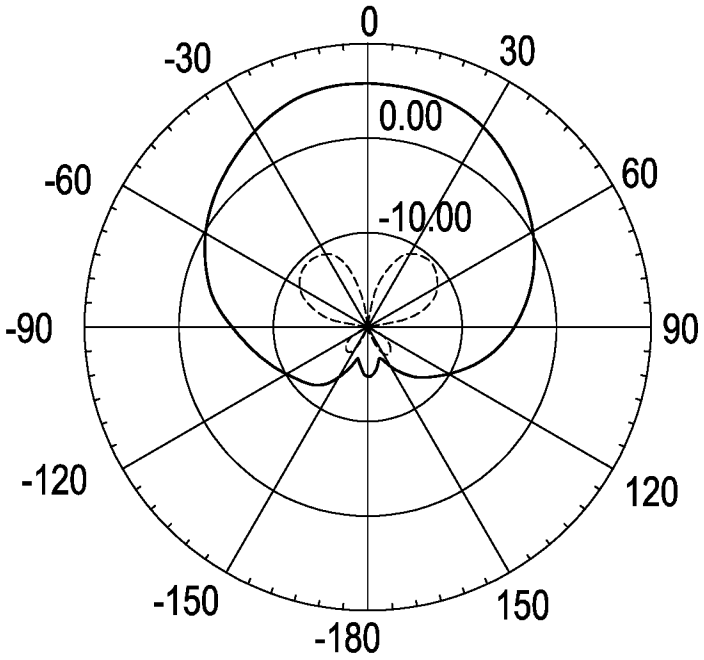
FIG. 5B is a view of a Far-field pattern of the antenna structure of FIG. 1 on a YZ plane.
Figure 5A:
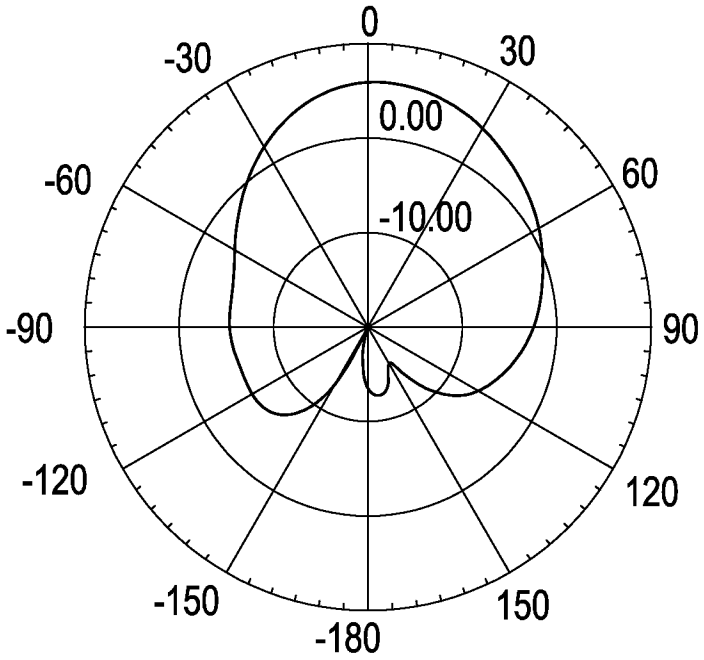
FIG. 5A is a view of a Far-field pattern of the antenna structure of FIG. 1 on an XZ plane.

FIG. 5A is a view of a Far-field pattern of the antenna structure of FIG. 1 on an XZ plane. FIG. 5B is a view of a Far-field pattern of the antenna structure of FIG. 1 on a YZ plane. It should be noted that in FIGS. 5A and 5B, a solid line refers to a radiation pattern of co-polarization, and a dashed line refers to a radiation pattern of cross-polarization. Referring to FIG. 5A and FIG. 5B, the antenna structure 100 of FIG. 1 has a good performance in the radiation pattern of co-polarization on the XZ plane and on the YZ plane, and the radiation pattern of cross-polarization is quite small, so that two curves has a high contrast in intensity.

Figure 6:
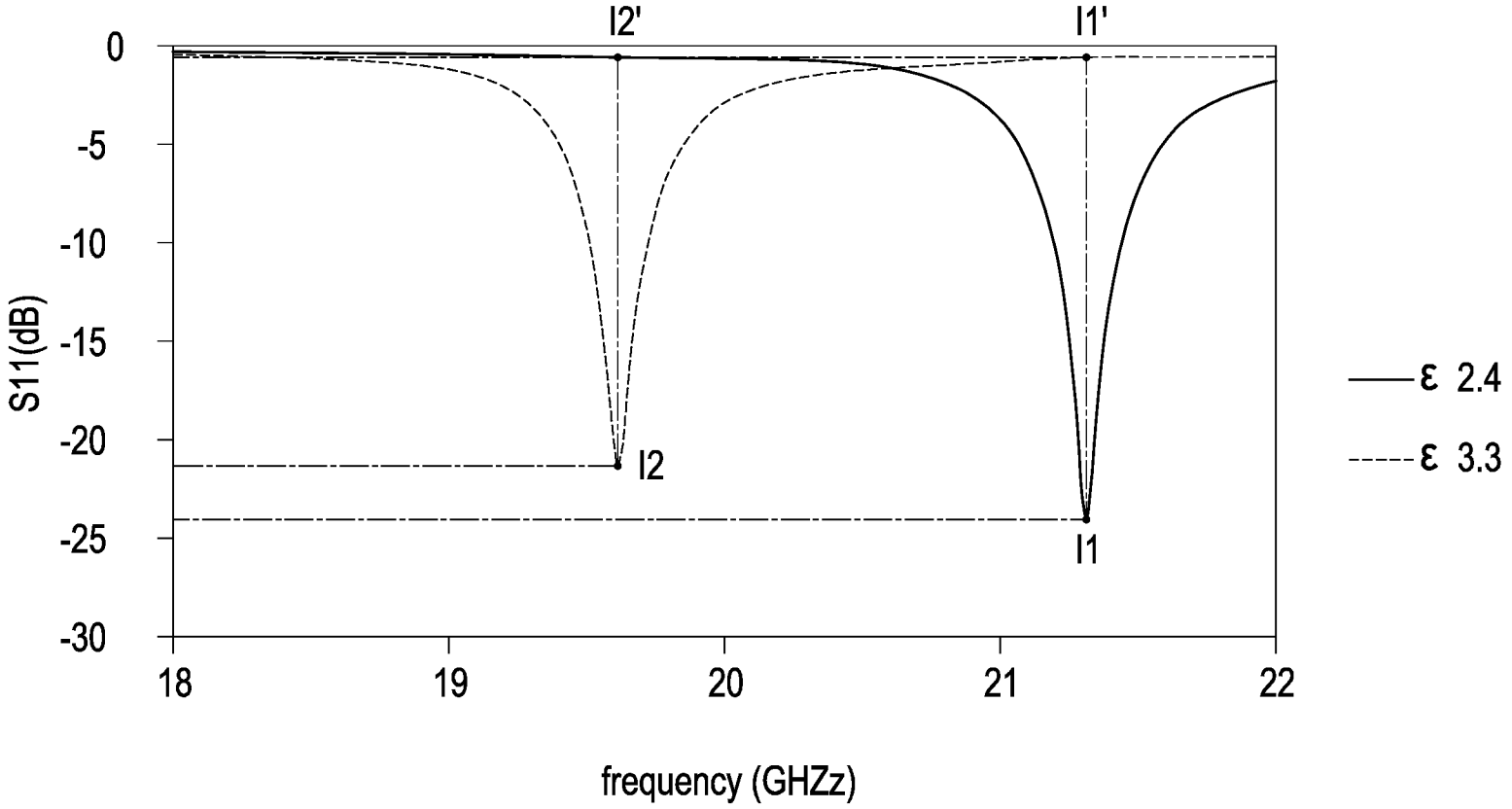
FIG. 6 is a view of a relationship between a frequency and S11 of the antenna structure of FIG. 1 under different dielectric constants of a liquid crystal layer.

FIG. 6 is a view of a relationship between a frequency and S11 of the antenna structure of FIG. 1 under different dielectric constants of a liquid crystal layer. Referring to FIG. 6, in this embodiment, when an operating frequency is set to 21.3 GHz, a dielectric constant ε of the liquid crystal layer 150 is 2.4 in a state where the antenna structure 100 is not supplied with the voltage. When the X coordinate is 21.3 GHz, I1 is taken as an example for S11 (a reflection coefficient) corresponding to the Y coordinate. That I1 is close to −24 dB means that most of the fed radiant energy is radiated, so that only a small amount of energy is reflected, which has a good radiation performance. Therefore, the antenna structure 100 excites a radiation signal (ON) of 21.3 GHz. In a state where the voltage (9V) is supplied to the antenna structure 100, the dielectric constant ε of the liquid crystal layer 150 is 3.3. When the X coordinate is 21.3 GHz, I1' of S11 (the reflection coefficient) corresponding to the Y coordinate is close to −1 dB to −2 dB, which means that most of the fed radiant energy is reflected back to a feeding end, and the radiation performance is pretty poor. Therefore, the antenna structure 100 may be said to have no radiation signal (OFF) of 21.3 GHz at this time.

Conversely, if the operating frequency is defined as 19.6 GHz, the dielectric constant ε of the liquid crystal layer 150 is 3.3 in the state where the voltage (9V) is supplied to the antenna structure 100. When the X coordinate is 19.6 GHz, I2 is taken as an example for S11 (the reflection coefficient) corresponding to the Y coordinate, which is close to −21 dB and means that most of the fed radiant energy is radiated, so that only a small amount of energy is reflected, which has a good radiation performance. Therefore, the antenna structure 100 may excite a radiation signal (ON) of 19.6 GHz. In the state where the antenna structure 100 is not supplied with the voltage, the dielectric constant ε of the liquid crystal layer 150 is 2.4. When the X coordinate is 19.6 GHz, I2' of S11 (the reflection coefficient) corresponding to the Y coordinate is less than −1 dB, which means that most of the fed radiant energy is reflected back to the feeding end, and the radiation performance is pretty poor. Therefore, the antenna structure 100 may be said to have no radiation signal (OFF) of 19.6 GHz at this time.

In other words, the antenna structure 100 of this embodiment may change the dielectric constant ε of the liquid crystal layer 150 between 2.4 and 3.3 through no voltage or the voltage of 9V, thereby achieving an effect of changing the radiation frequency between 21.3 GHz and 19.6 GHz.

According to a capacitance formula, $C=\varepsilon*A/D$, where C is a capacitance, and ε is a dielectric constant. A is an area of a conductor, and D is a distance between the first plane P1 and the second plane P2. When the dielectric constant ε changes, the capacitance changes accordingly. Furthermore, according to a frequency formula, $f=1/(2\pi\sqrt{(L*C)})$, where L is an inductance, and C is the capacitance. When the capacitance changes, the frequency also changes accordingly. Therefore, the antenna structure 100 of this embodiment changes the dielectric constant ε of the liquid crystal layer 150 by the multi-capacitance path, thereby achieving an effect of frequency modulation.

Compared with the conventional technology that requires the thick liquid crystal layer to achieve similar frequency modulation, the antenna structure 100 of this embodiment may have the thin liquid crystal layer 150, and the frequency modulation may be achieved by applying a lower voltage. In addition, at 21.3 GHz, the antenna structure 100 of this embodiment may obtain a switching ratio of about 9% (a radiation efficiency of the radiation signal (OFF)/a radiation efficiency of the radiation signal (ON)), and the radiation frequency of about 8% may be modulated (a difference between 21.3 GHz and 19.6 GHz/21.3 GHz), which may be applied to array antennas, and may effectively achieve an effect of beamforming.

Figure 7A:
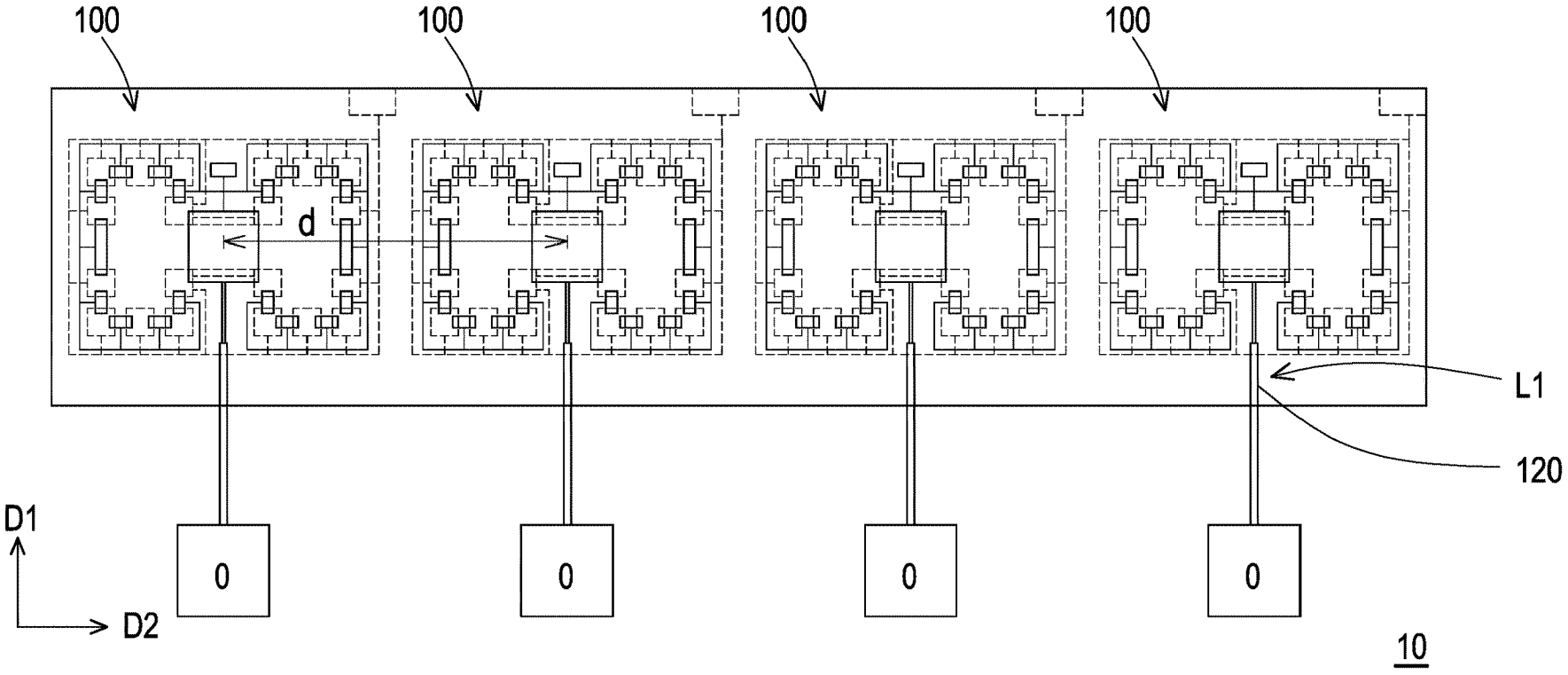
FIGS. 7A, 7C, and 7E are schematic views of various array antenna modules according to various embodiments of the disclosure.
Figure 7B:
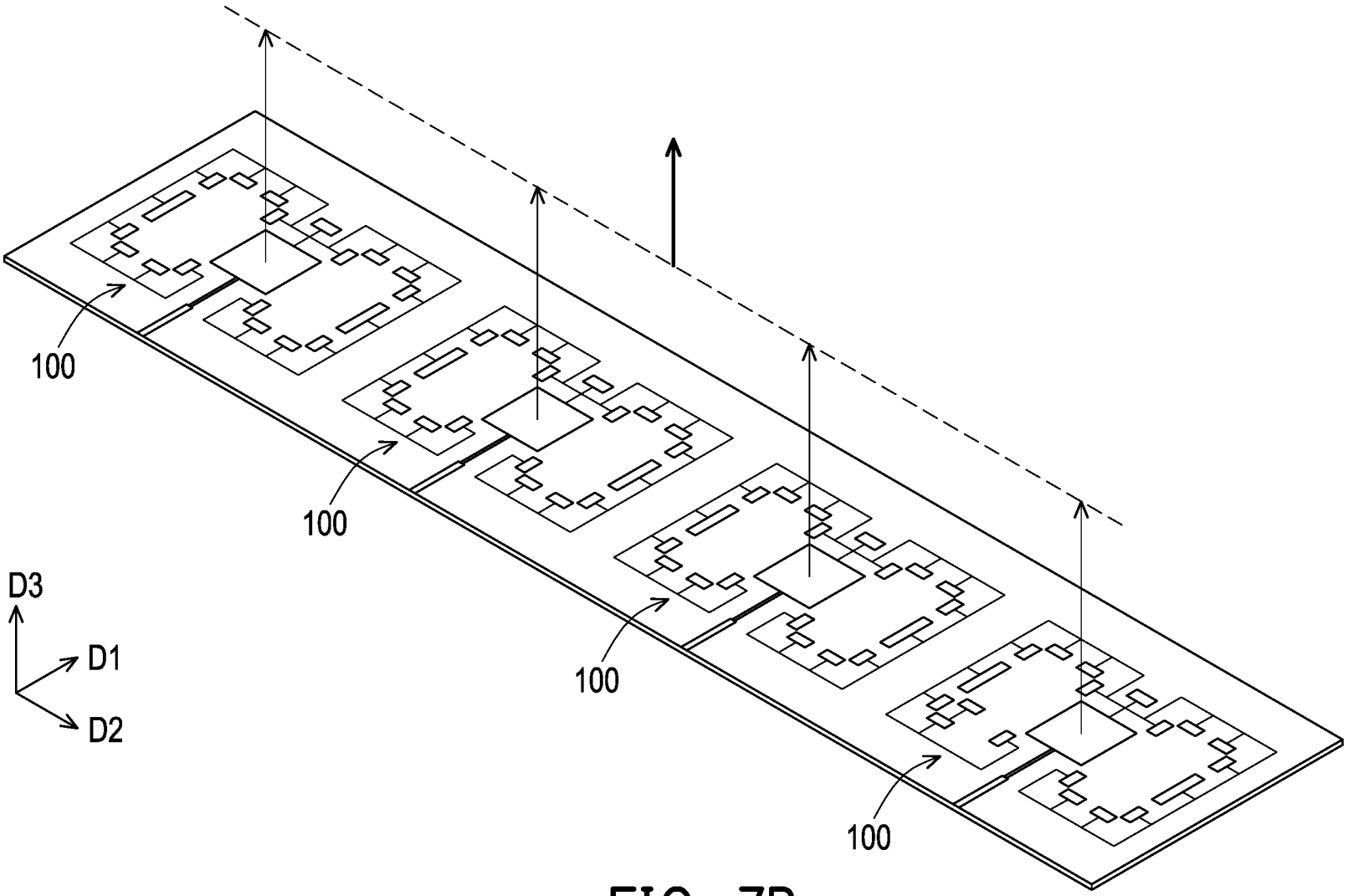
FIGS. 7B, 7D, and 7F are respectively schematic views of an antenna radiation direction of the array antenna modules of FIGS. 7A, 7C, and 7E.
Figure 7C:
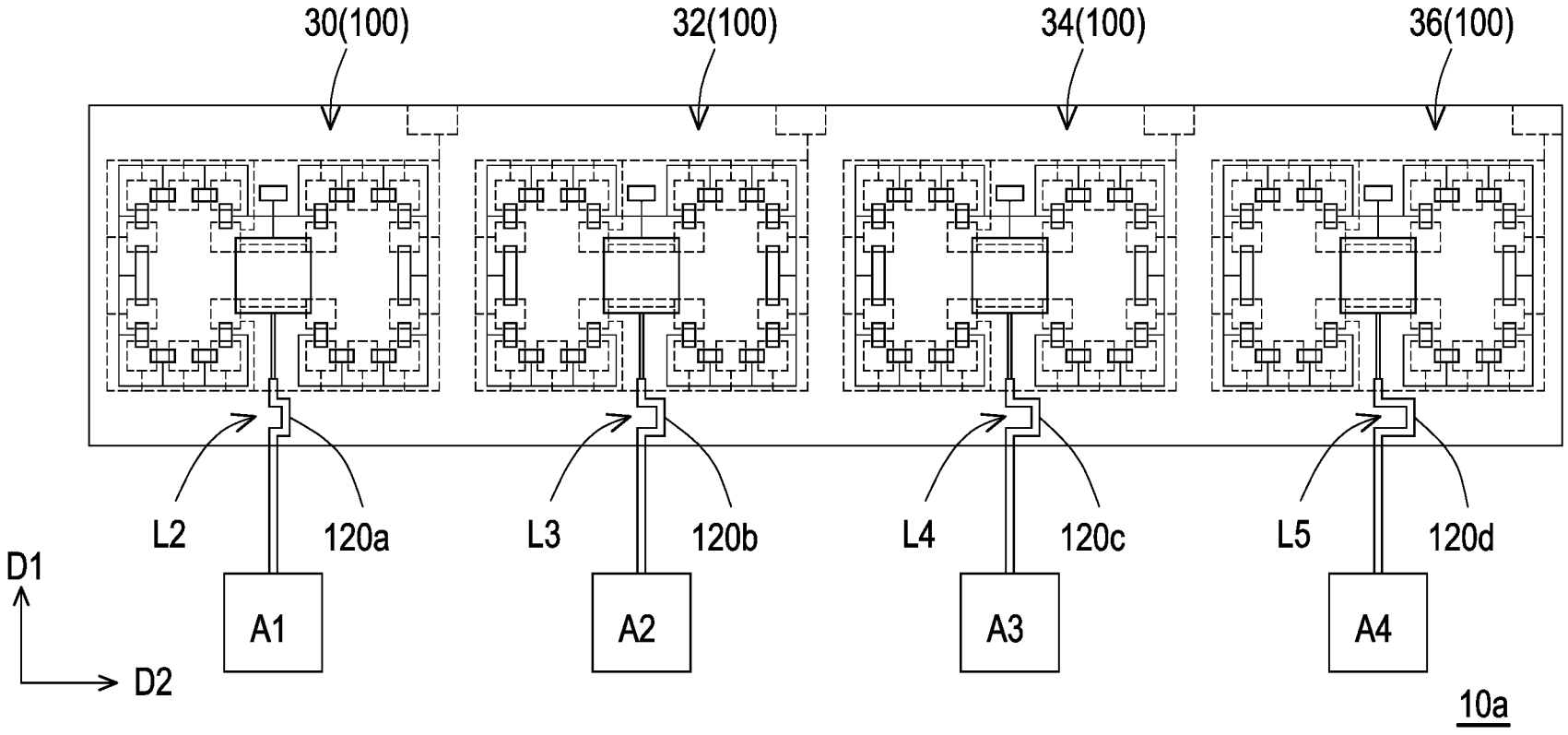
Figure 7D:
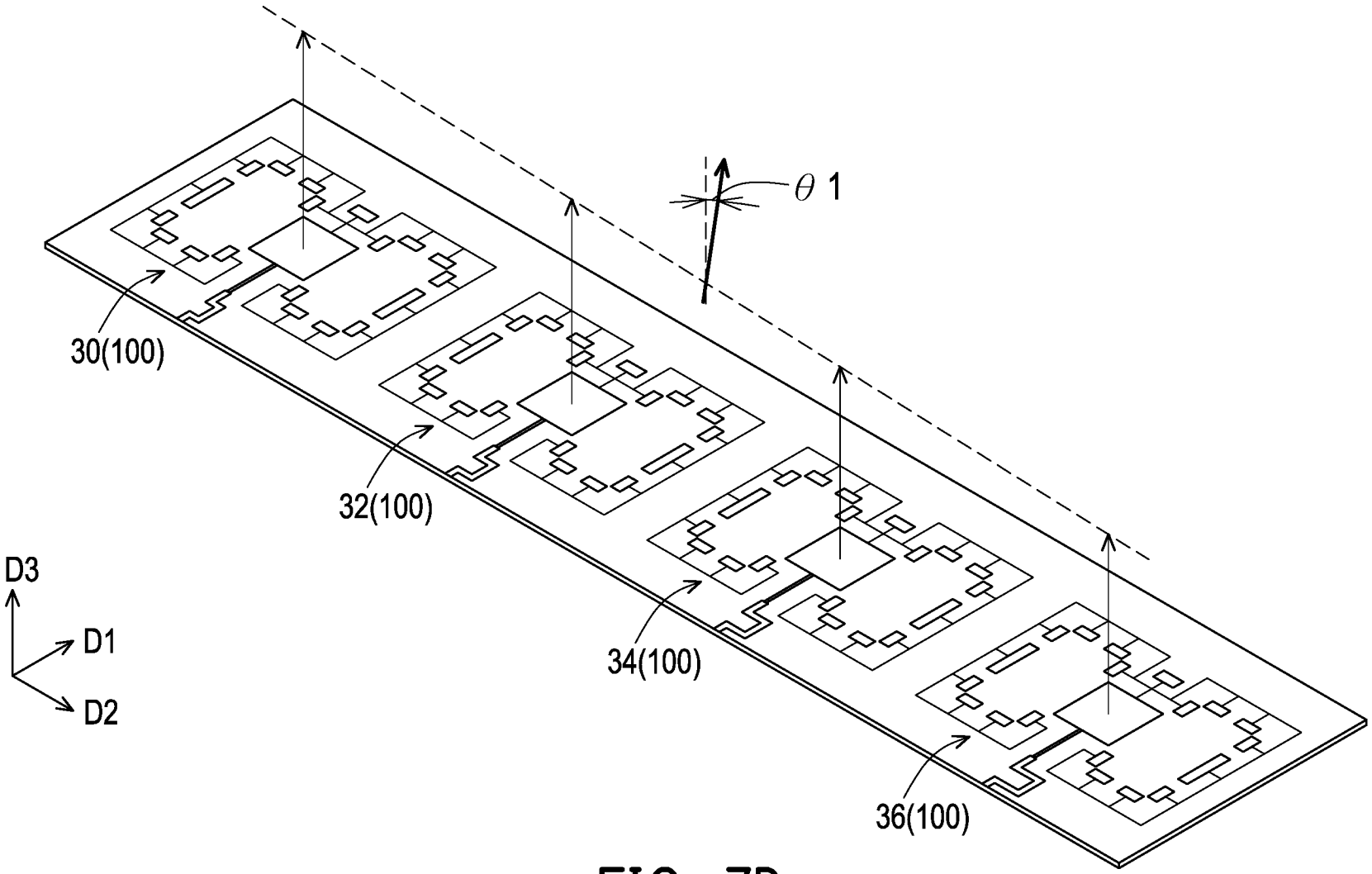
Figure 7E:
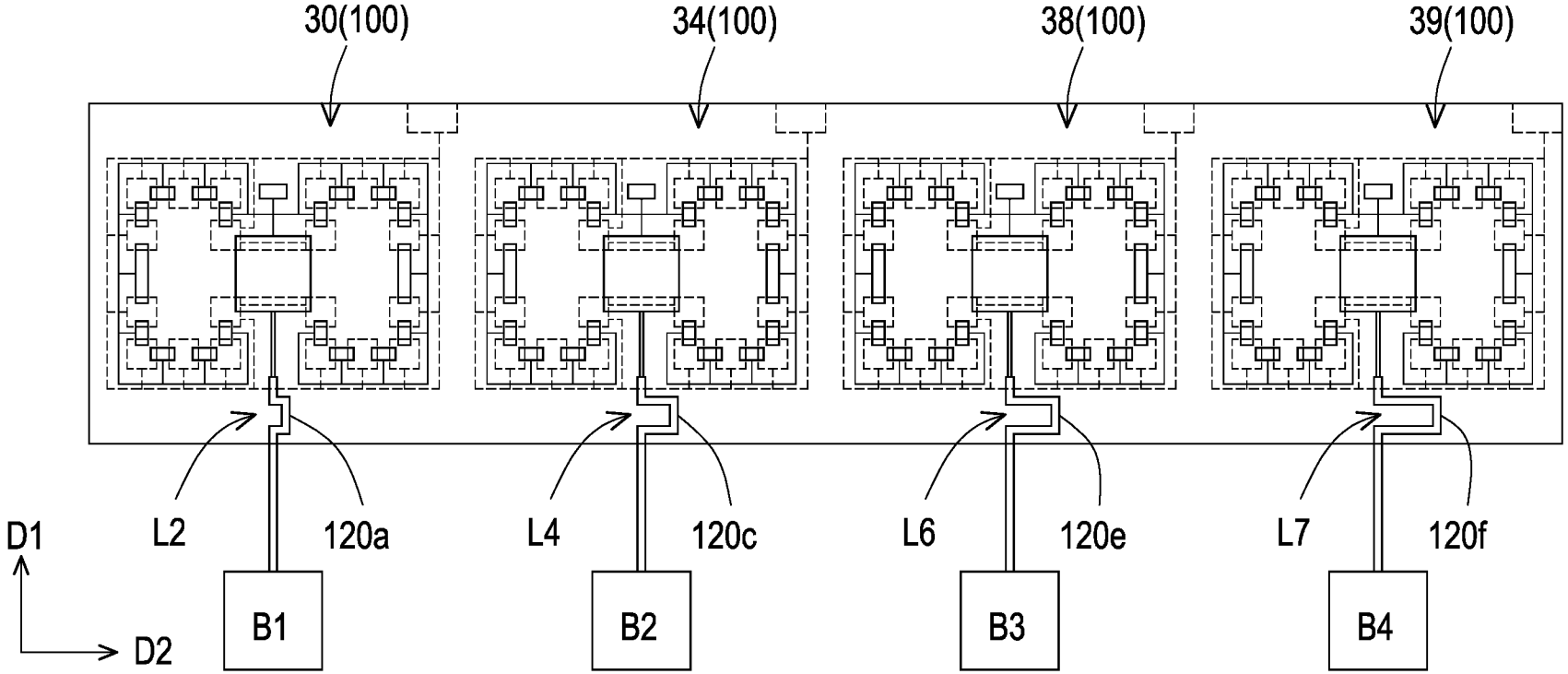
Figure 7F:
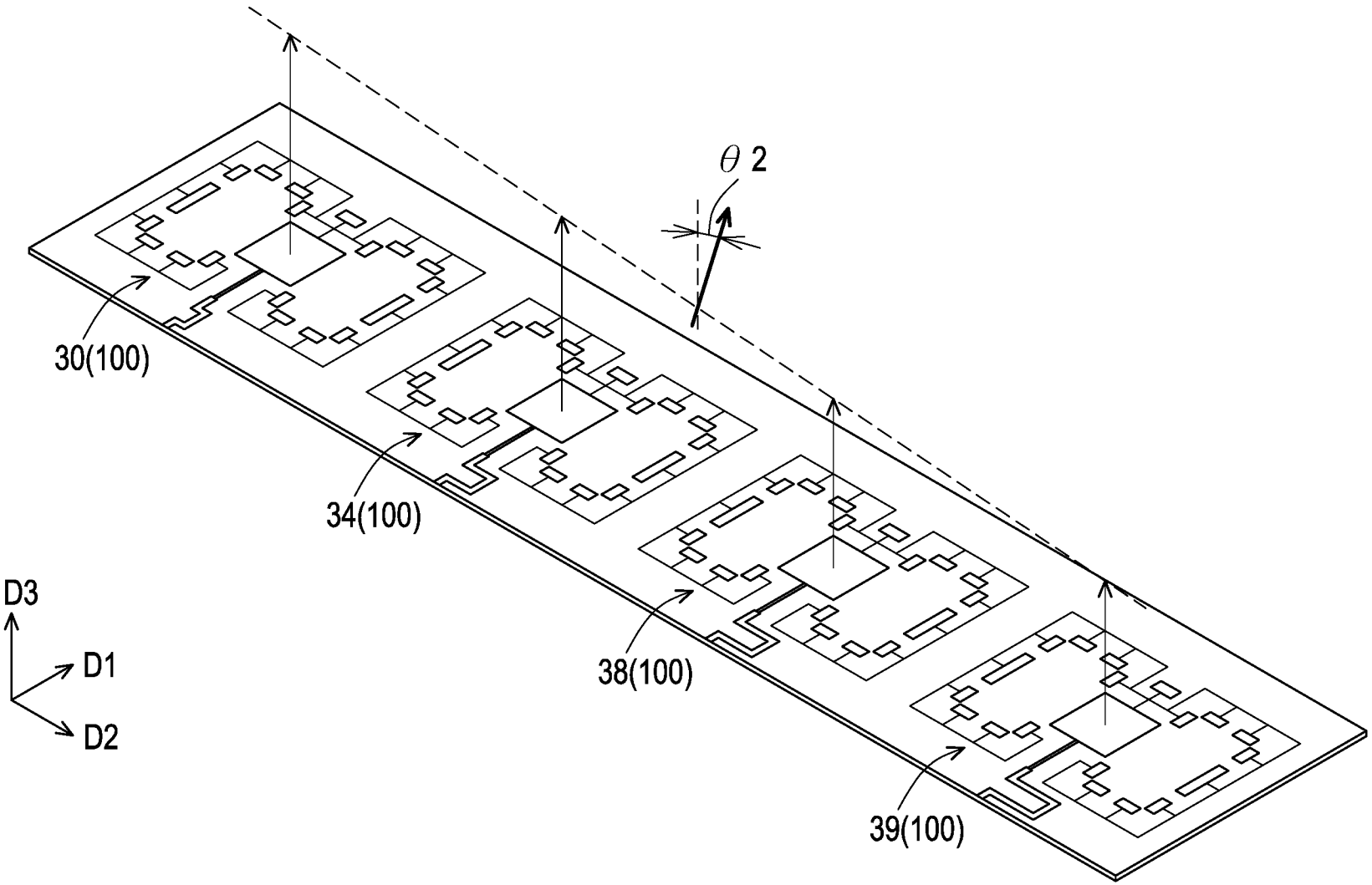

FIGS. 7A, 7C, and 7E are schematic views of various array antenna modules according to various embodiments of the disclosure. FIGS. 7B, 7D, and 7F are respectively schematic views of an antenna radiation direction of the array antenna modules of FIGS. 7A, 7C, and 7E. Note that squares indicating phases shown in FIGS. 7A, 7C, and 7E are only used to facilitate understanding, and do not denote actual components. In addition, where not shown in the figure, the microstrip lines of the antenna structures are connected together. The radiation signals enter the microstrip lines together, and after entering the microstrip lines of the same or different lengths, the same or different phases are generated. In addition, FIGS. 7B, 7D, and 7F only show a pattern of the uppermost layer of the antenna structure.

Referring to FIGS. 7A and 7B, in this embodiment, an array antenna module 10 includes multiple antenna structures 100 of FIG. 1, which are arranged in an array along the second extending direction D2. In this embodiment, an array of 1×4 is taken as an example, but the form of the array is not limited thereto. A third extending direction D3 is perpendicular to the first extending direction D1 and the second extending direction D2. The third extending direction D3 is, for example, a normal direction of a substrate carrying the antenna structure 100. In this embodiment, phases of the four antenna structures 100 are all 0, that is, a phase difference is 0, so that a radiation direction of the summed antennas is perpendicular to the first extending direction D1 and the second extending direction D2, and parallel to the third extending direction D3.

Referring to FIGS. 7C and 7D, in this embodiment, the antenna structures 100 of an array antenna module 10*a* include multiple first antenna structures 30, 32, 34, and 36. Microstrip lines 120*a*, 120*b*, 120*c*, and 120*d* of the first antenna structures 30, 32, 34, and 36 have a variety of lengths L2, L3, L4, and L5. The lengths L2, L3, L4, and L5 of the microstrip lines 120 are all greater than a length L1 of the microstrip line 120 when the phase is 0, so that phases of the first antenna structures 30, 32, 34, and 36 are non-zero, and a phase difference is non-zero.

In this embodiment, a phase change is adjusted by adjusting the lengths of the microstrip lines 120*a*, 120*b*, 120*c*, and 120*d*. A difference between the lengths of any two adjacent ones of the microstrip lines 120*a*, 120*b*, 120*c*, and 120*d* of the first antenna structures 30, 32, 34, and 36 is $\lambda g*(P/360)$, where λg is an effective wavelength of a feeding signal in the antenna structure 100. That is, the feeding signal is a wavelength when transmitted in media such as the patch antenna 110, the first conductor 132, the second conductor 142, the first substrate 160, the second substrate 162, and the liquid crystal layer 150 in FIG. 2. P is a phase difference (°) between the two adjacent microstrip lines 120.

In addition, along the second extending direction D2, phases A1, A2, A3, and A4 of the first antenna structures 30, 32, 34, and 36 are an arithmetic series. For example, the phases A1, A2, A3, and A4 may be 20, 40, 60, and 80, but are not limited thereto.

As shown in FIG. 7D, the phase differences cause positions of radiation equiphase wavefronts (denoted by length) of the first antenna structures 30, 32, 34, and 36 in the third extending direction D3 to be different. The antenna radiation direction is affected by a normal direction of the radiation equiphase wavefronts, and is orthogonal to a line of multiple arrows in the figure (the dashed line in the figure). In addition, an angle θ1 in included between the antenna radiation direction and the third extending direction D3, and the angle θ1 is greater than 0 and less than 90 degrees. As the phase difference of the antenna structure 100 is different, the angle of the antenna radiation direction is also different. Specifically, the phase difference of the antenna structure 100 is $P=(360*d*\sin\theta)/\lambda$, where θ is a radiation angle, while λ is a radiation wavelength, and d is a distance between any two adjacent ones of the first antenna structures 30, 32, 34, and 36, for example, a distance between two centers of the two adjacent patch antennas 110 (FIG. 1). A designer may obtain the desired radiation angle by controlling the above variables.

Referring to FIGS. 7E and 7F, in an array antenna module 10*b* of this embodiment, phases B1, B2, B3, and B4 of the first antenna structures 30, 34, 38, and 39 along the second extending direction D2 are the arithmetic series. For example, the phases B1, B2, B3, and B4 may be 20, 60, 100, and 140, but are not limited thereto. A phase difference of the first antenna structures 30, 34, 38, and 39 in FIG. 7E is greater than a phase difference of the first antenna structures 30, 32, 34, and 36 in FIG. 7C. Therefore, an angle θ2 between the antenna radiation direction and the third extending direction D3 in FIG. 7F is greater than the angle θ1 in FIG. 7D.

In light of the above, the designer may achieve an effect of adjusting the antenna radiation direction by configuring the antenna structure 100 with different phases.

Figure 8A:
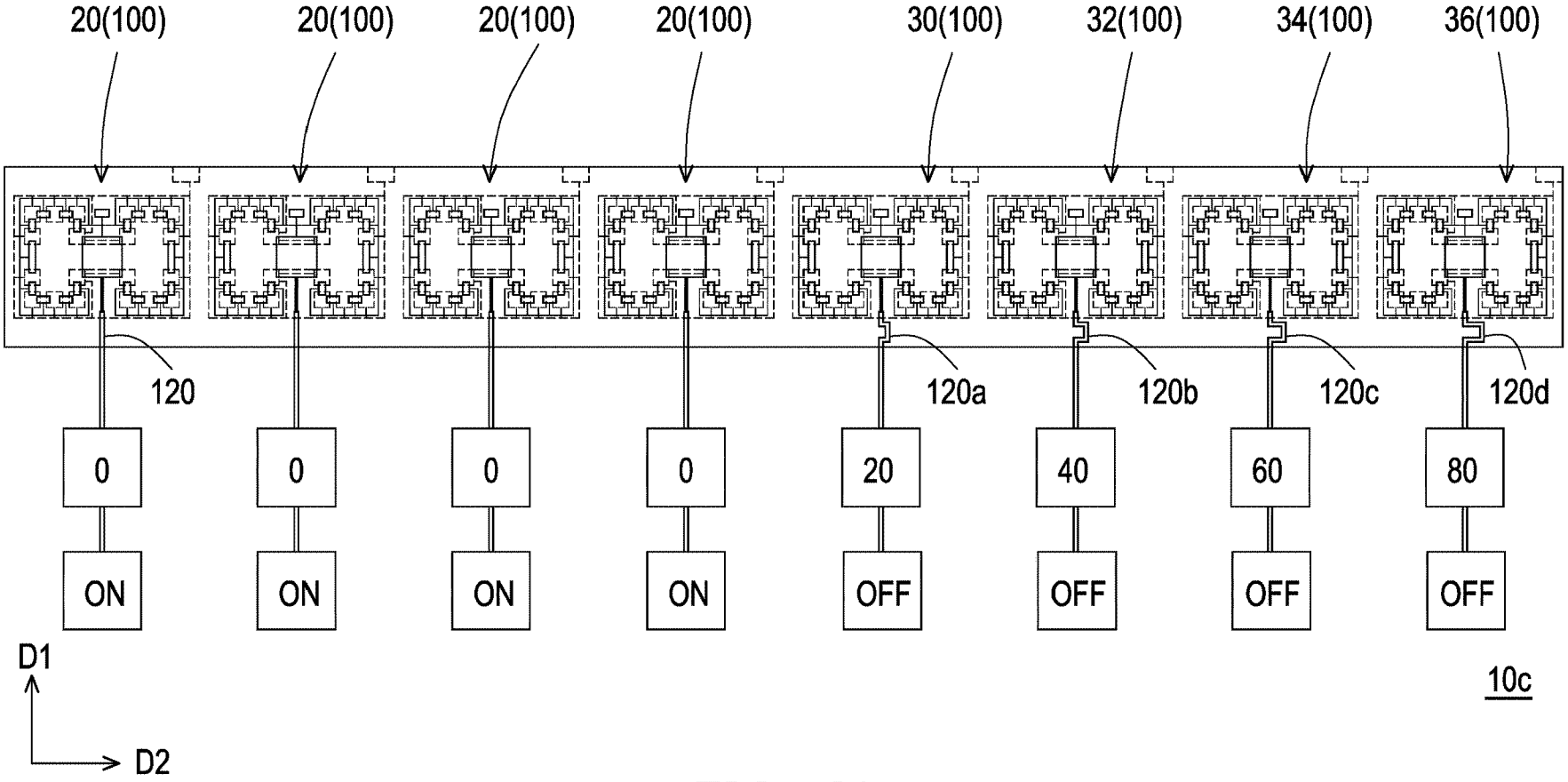
FIGS. 8A and 8B are schematic views of an antenna radiation direction of an array antenna module at different voltages according to another embodiment of the disclosure.
Figure 8B:
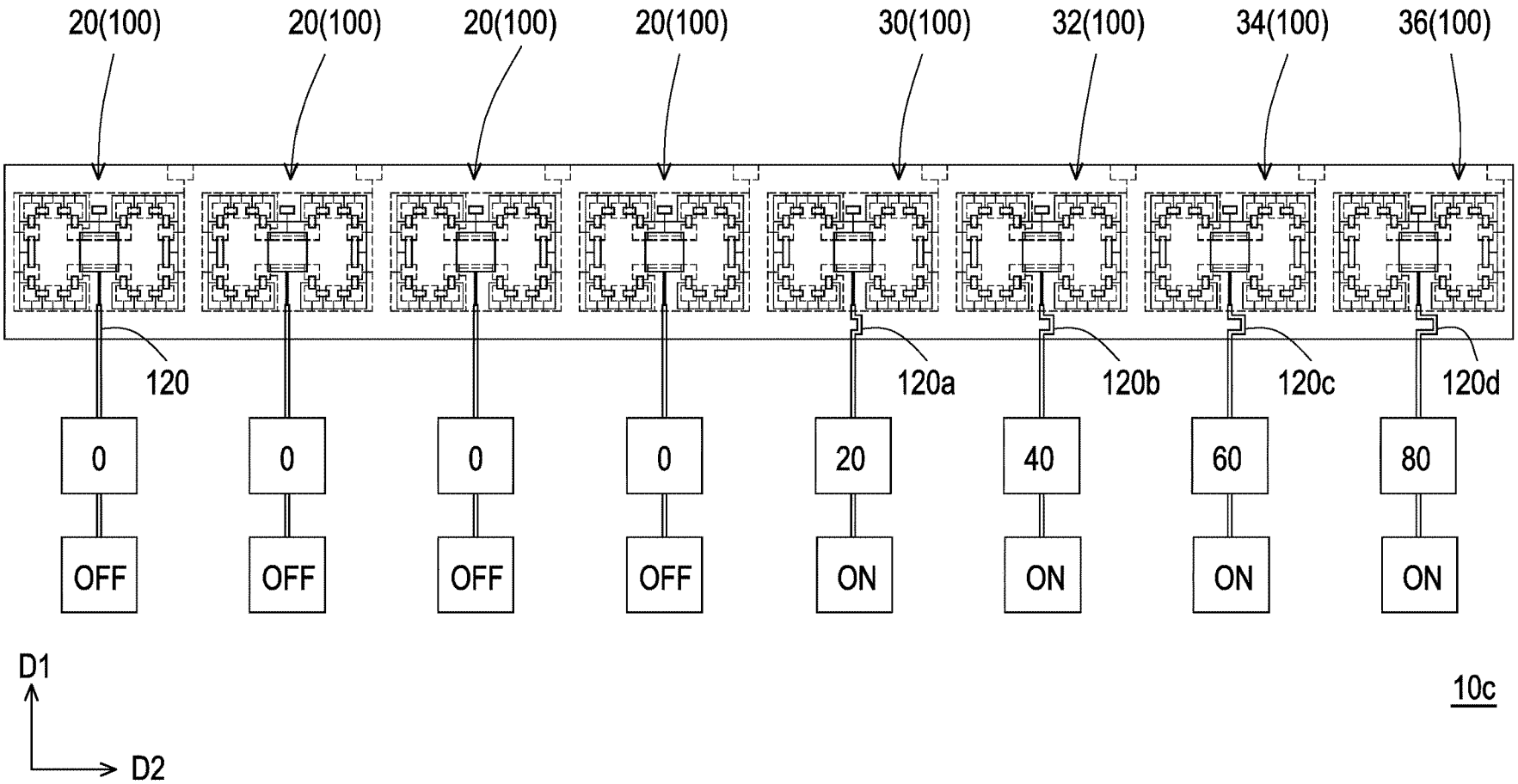

FIGS. 8A and 8B are schematic views of an antenna radiation direction of an array antenna module at different voltages according to another embodiment of the disclosure. Note that squares indicating phases shown in FIGS. 8A and 8B are only used to facilitate understanding, and do not denote the actual components. Where not shown in the figure, the microstrip lines of the antenna structures are connected together. The radiation signals enter the microstrip lines together, and after entering the microstrip lines of the same or different lengths, the same or different phases are generated.

Referring to FIG. 8A, in this embodiment, an array antenna module 10*c* includes multiple first antenna structures 30, 32, 34, and 36, and multiple second antenna structures 20. Phases of the first antenna structures 30, 32, 34, and 36 are non-zero (for example, 20, 40, 60, and 80), and have a phase difference. Phases of the second antenna structures 20 is 0 without a phase difference. Lengths of the microstrip lines 120 of the first antenna structures 30, 32, 34, and 36 are greater than lengths of the microstrip lines 120 of the second antenna structures 20.

The first antenna structures 30, 32, 34, and 36, and the second antenna structures 20 are successively arranged along the second extending direction D2, and the antenna radiation direction may be adjusted by operating at different timings. In an embodiment, the first antenna structures 30, 32, 34, and 36, and the second antenna structures 20 may also be successively arranged along the first extending direction D1.

Specifically, as shown in FIG. 8A, when the first antenna structures 30, 32, 34, and 36 do not have the radiation signals (OFF) and the second antenna structures 20 have the radiation signals (ON), an antenna radiation direction of the antenna structure 20 is perpendicular to the first extending direction D1 and the second extending direction D2 as shown in FIG. 7B, and extends along the third extending direction D3. Specifically, in this embodiment, when the operating frequency is set to 21.3 GHz, the thin film transistors 136 (FIG. 1) of the first antenna structures 30, 32, 34, and 36 are supplied with the voltage, and when the thin film transistors 136 of the second antenna structures 20 are not supplied with the voltage, the antenna radiation direction that is perpendicular to the first extending direction D1 and the second extending direction D2, and extends along the third extending direction D3 may be obtained.

As shown in FIG. 8B, when the first antenna structures 30, 32, 34, and 36 have the radiation signals (ON), and the second antenna structures 20 do not have the radiation signals (OFF), the angle θ1 is included between the antenna radiation direction of the first antenna structures 30, 32, 34, and 36, and the third extending direction D3 as shown in FIG. 7D. The angle θ1 is greater than 0 and less than 90 degrees. Specifically, in this embodiment, when the operating frequency is set to 21.3 GHz, the thin film transistors 136 of the first antenna structures 30, 32, 34, and 36 are not supplied with the voltage, and when thin film transistors 136 of the second antenna structures 20 are supplied with the voltage, the antenna radiation direction having the angle θ1 included between the third extending direction D3 may be obtained.

Of course, the angle of the antenna radiation direction varies according to the phase and antenna configuration. The designer may adjust the configuration of the antenna structure 100 and the switch settings of the antenna structure 100 according to requirements to control the phase difference (with/without phase difference), and then change the angle of the antenna radiation direction to achieve an effect of antenna radiation beam switching.

Based on the above, in the antenna structure of the disclosure, the two first radiation assemblies are respectively disposed on the two sides of the patch antenna, and the two second radiation assemblies are disposed under the two first radiation assemblies. The projection of the two second radiation assemblies on the first plane, the two first radiation assemblies, and the two edges of the patch antenna collectively form the two loops. The liquid crystal layer is disposed between the first plane and the second plane. The ground plane is disposed under the two second radiation assemblies. In the disclosure, the first conductors and the second conductors are disposed above and below the liquid crystal layer to generate the multi-capacitance path of the signal. In the conventional technology, the antenna structure using the liquid crystal layer determines the radiation frequency offset by the thickness of the liquid crystal layer, and thus the thick liquid crystal layer is required. In the antenna structure of the disclosure, through the above multi-capacitance path, the fringe radiation field of the patch antenna may change the radiation frequency according to the capacitance change generated by the multi-capacitance path. Therefore, the thickness of the liquid crystal layer of the antenna structure in the disclosure may be greatly reduced, thereby reducing the cost and power consumption.

What is claimed is:

1. An antenna structure comprising:

a patch antenna comprising two opposite edges;

a microstrip line connected to the patch antenna;

two first radiation assemblies respectively disposed on two sides of the patch antenna, wherein the patch antenna, the microstrip line, and the two first radiation assemblies are located on a first plane, and each of the first radiation assemblies comprises a plurality of separated first conductors;

two second radiation assemblies disposed under the two first radiation assemblies and located on a second plane, wherein each of the second radiation assemblies comprises a plurality of separated second conductors, and a projection of the two second radiation assemblies on the first plane, the two first radiation assemblies, and the two edges of the patch antenna collectively form two loops;

a liquid crystal layer disposed between the first plane and the second plane; and a ground plane disposed under the two second radiation assemblies.

2. The antenna structure according to claim 1, wherein an extending direction of the two edges of the patch antenna extends toward a first extending direction of the microstrip line, and each of the loops has a long side extending toward the first extending direction of the microstrip line.

3. The antenna structure according to claim 1, wherein a width of the first conductor in an extending direction of a short side is less than a width of the second conductor in the extending direction.

4. The antenna structure according to claim 1, wherein the two second radiation assemblies are connected to each other through two conducting wires, the two second radiation assemblies are divided into an inner zone and two outer zones located at two sides of the inner zone by a second extending direction of the two conducting wires, and the second conductors of the second radiation assemblies are only located in the two outer zones.

5. The antenna structure according to claim 1, wherein the first conductors are staggered from the second conductors.

6. The antenna structure according to claim 1, further comprising a thin film transistor and a plurality of first circuits connected to the thin film transistor and the first conductors, wherein the first conductors are electrically connected to the thin film transistor through the first circuits, and the thin film transistor supplies a voltage to the first conductors to adjust a dielectric constant of the liquid crystal layer.

7. The antenna structure according to claim 6, wherein the first circuits are respectively perpendicular to the connected first conductors.

8. The antenna structure according to claim 1, further comprising a plurality of second circuits connected to the ground plane and the second conductors, wherein the second conductors are electrically connected to the ground plane through the second circuits.

9. The antenna structure according to claim 8, wherein the second circuits are respectively perpendicular to the connected second conductors.

10. The antenna structure according to claim 1, further comprising a first substrate and a second substrate disposed up and down and separated from each other, wherein the patch antenna, the microstrip line, and the two first radiation assemblies are disposed on the first substrate, the two second radiation assemblies are disposed on the second substrate, the first plane is a surface of the first substrate facing the second substrate, the second plane is a surface of the second substrate facing the first substrate, and the liquid crystal layer is located between the first substrate and the second substrate.

11. The antenna structure according to claim 10, wherein the ground plane is disposed on a surface of the second substrate away from the first substrate.

12. The antenna structure according to claim 10, wherein the ground plane is disposed on a third substrate, and the ground plane is attached to a surface of the second substrate away from the first substrate.

13. The antenna structure according to claim 1, wherein the antenna structure resonates in a frequency band, and a thickness of the liquid crystal layer is less than 0.005 times a wavelength of the frequency band.

14. An array antenna module, comprising:

a plurality of antenna structures according to claim 1 arranged in an array.

15. The array antenna module according to claim 14, wherein the antenna structures comprise a plurality of first antenna structures, the microstrip lines of the first antenna structures have a variety of lengths, a phase difference of the first antenna structures is non-zero, and phases of the first antenna structures along a second extending direction are an arithmetic series.

16. The array antenna module according to claim 14, wherein a difference between lengths of any two adjacent ones of the microstrip lines of the first antenna structures is $\lambda g*(P/360)$, wherein $\lambda g$ is an effective wavelength of a feeding signal in the antenna structure, and P is a phase difference (°) of the two adjacent microstrip lines.

17. The array antenna module according to claim 14, wherein a phase difference of the first antenna structures is $P=(360*d*\sin\theta)/\lambda$, wherein $\theta$ is a radiation angle, $\lambda$ is a radiation wavelength, and d is a distance between any two adjacent ones of the first antenna structures.

18. The array antenna module according to claim 14, wherein the antenna structures further comprise a plurality of second antenna structures, a phase difference of the second antenna structures is 0, a plurality of first antenna structures and the second antenna structures are successively arranged along a second extending direction or a first extending direction, and an antenna radiation direction is adjusted by operating at different timings.

19. The array antenna module according to claim 18, wherein a third extending direction is perpendicular to the first extending direction and the second extending direction, when the first antenna structures have radiation signals (ON), and the second antenna structures do not have the radiation signals (OFF), an angle is included between the antenna radiation direction and the third extending direction, and the angle is greater than 0 and less than 90 degrees, when the first antenna structures do not have the radiation signals (OFF), and the second antenna structures have the radiation signals (ON), the antenna radiation direction is parallel to the third extending direction.

20. The array antenna module according to claim 18, wherein lengths of the microstrip lines of the first antenna structures are greater than lengths of the microstrip lines of the second antenna structures.

* * * * *